United States Patent [19]

Hondorp

[11] 4,437,013

[45] Mar. 13, 1984

[54] NEUTRON AND GAMMA RADIATION SHIELDING MATERIAL, STRUCTURE, AND PROCESS OF MAKING STRUCTURE

[75] Inventor: Hugh L. Hondorp, Princeton Junction, N.J.

[73] Assignee: The United States of America as represented by the Department of Energy, Washington, D.C.

[21] Appl. No.: 280,576

[22] Filed: Jul. 6, 1981

[51] Int. Cl.[3] ..... G21C 11/00; G21F 3/02

[52] U.S. Cl. ..... 250/515.1; 250/518.1; 250/519.1; 252/478

[58] Field of Search ..... 250/517, 518, 519; 252/478; 106/84, 38.3

[56] References Cited

U.S. PATENT DOCUMENTS

| | | | |
|---|---|---|---|
| 2,747,105 | 5/1956 | Fitzgerald et al. | 252/478 |
| 2,833,664 | 5/1958 | Knapp | 252/478 |
| 3,609,372 | 9/1971 | Vogel | 250/518.1 |
| 4,065,317 | 12/1977 | Baak et al. | 252/478 |
| 4,172,110 | 10/1979 | Caesar et al. | 106/84 |
| 4,199,365 | 4/1980 | Randall | 106/84 |
| 4,208,216 | 6/1980 | Yamaguchi et al. | 106/84 |

FOREIGN PATENT DOCUMENTS

| | | | |
|---|---|---|---|
| 8014589 | 6/1980 | France | 252/478 |

*Primary Examiner*—Bruce C. Anderson
*Attorney, Agent, or Firm*—Michael F. Esposito

[57] ABSTRACT

The present invention is directed to a novel neutron and gamma radiation shielding material consisting of 95 to 97 percent by weight $SiO_2$ and 5 to 3 percent by weight sodium silicate. In addition, the method of using this composition to provide a continuous neutron and gamma radiation shielding structure is disclosed.

13 Claims, No Drawings

NEUTRON AND GAMMA RADIATION SHIELDING MATERIAL, STRUCTURE, AND PROCESS OF MAKING STRUCTURE

The U.S. Government has rights in the present invention pursuant to Contract No. S-01322-P between the U.S. Department of Energy and Bechtel National, Inc.

BACKGROUND OF THE INVENTION

The present invention is directed to composition for use as a neutron or gamma radiation shielding material. In particular, the present invention is directed to the use of a composition consisting of $SiO_2$ and sodium silicate in the formation of a neutron or gamma radiation shielding structure.

The problem of radiation shielding about nuclear facilities is well known. The radiation shielding provided around these facilities is often fabricated from large concrete blocks rather than monolithic concrete. The use of blocks permits reconfiguration of the shield for different experiments, and allows the shield to be disassembled for access to components located behind it. In addition, the shielding blocks are normally provided with a stepped offset to avoid direct line-of-sight radiation streaming. Because of the rather loose tolerances inherent in concrete block formation, large gaps can result between adjacent blocks. The development of a suitable radiation resistant material which can be used to fill (i.e., caulk) these gaps has been the subject of extensive research.

The material chosen as the "caulking" or radiation shielding material should be capable of functioning as either a neutron or gamma shield, or both, dependent upon the radiation source. Heavy or moderately heavy elements are usually used to attenuate the gamma radiation and to slow down very fast neutrons to about 1 MeV by inelastic collisions. Hydrogenous materials are used to moderate neutrons with energies below 1 MeV by means of elastic collisions. Materials, most notably those containing boron, are used to capture thermal neutrons without producing high energy gamma rays.

The material chosen as a radiation shielding material or "caulking" should preferably be applicable as a high viscosity paste or a liquid so as to completely fill the gaps. In addition, it should dry to a solid which is readily removable should disassembly of the shielding blocks be required. The material should also display low neutron activation characteristics, good thermal and radiation stability, and either be nonflammable or else not give off noxious or poisonous fumes during combustion.

A number of candidates for use as a radiation shielding material or "caulking material" have been considered. A list of these materials appears in Table I below, along with their potential use as either a neutron only, gamma only, or combination neutron/gamma shield.

TABLE I

FUNCTIONAL CAPABILITIES OF CANDIDATE RADIATION SHIELDING

| Material | Neutron | Gamma | Combination |
|---|---|---|---|
| Lead/lead alloys | | x | |
| Masonite TM | x | | |
| Boral TM | x | | |
| Permali NH TM | x | | |
| Permali JN TM | x | | |
| Silicone foam | x | x (with lead) | x (with lead) |
| Polyethylene | x | x (with lead) | x (with lead) |

TABLE I-continued

FUNCTIONAL CAPABILITIES OF CANDIDATE RADIATION SHIELDING

| Material | Neutron | Gamma | Combination |
|---|---|---|---|
| Ricorad TM | x | | |
| Polystyrene | x | x (with lead) | x (with lead) |
| Water bags | x | | |
| Polyurethane | x | | |
| Epoxy grouts | x | x | x |

These materials are described in detail below.

Lead and lead alloys have been used as radiation shields predominantly because of their high density and ease of fabrication. For gamma rays with energies in the region of 2 MeV, approximately the same mass of lead as of iron is required to achieve the same degree of radiation attenuation. However, at both higher and lower energies, lead is more efficient. Because of its low melting point, lead can be used only in shields where the temperature is not too high.

Masonite TM, a compressed wood product, with a density of about 1.3 grams per cubic centimeter and containing about 6 weight percent of hydrogen, was used as the hydrogenous material in some early reactors. It formed part of laminated shields consisting of alternate layers of Masonite TM and iron. The number of $H_2$ atoms per cubic centimeter of Masonite TM is as high as about $5\times10^{22}$, which is not much less than water. In addition, it contains both carbon and oxygen which can act as moderators.

A boron containing solid which may have application for neutron shielding is the complex of boron carbide ($B_4C$) and aluminum known as Boral TM. The composition of Boral TM is variable but it generally contains from 30 to 50 percent by weight of boron carbide, and is available in sheets, either ¼ inch or ⅛ inch thick, clad on each side with 0.02 inch of aluminum. The product has a density of 2.5 grams per cubic centimeter; it has satisfactory mechanical properties and absorbs neutrons with no accompanying high-energy gamma radiation.

Permali NH TM is a special grade of densified beechwood laminate with a hydrogen content of approximately 6 percent. The beechwood veneers are impregnated under vacuum with a modified phenolic resin, and then densified through the application of heat and pressure. The densification required to produce Permali NH TM provides increased hydrogen concentration per unit volume. The hydrogen content is in the combined form, being a part of the hydrocarbon molecules of both constituents. Since the hydrogen is uniformly dispersed, the material is isotropic with respect to neutron shielding effectiveness. Permali NH TM is available in boards. For applications where neutron capture, not solely attenuation, is required, borated Permali JN TM is available. While maintaining a hydrogen content of approximately 6 percent, this material also contains 3 percent boron, uniformly dispersed throughout.

Silicone foam can be poured in place or sprayed in the form of an aerosol. Polyethylene film can be used as a "mold release" to assure that the caulking material can be separated from the shielding blocks. It has a typical 1 hour curing time. The maximum continuous service temperature is approximately 205° C. Oxidative degradation is the primary problem. It would reach a moderate activation level, and is a good neutron shield. With lead added, it is also a good gamma shield.

Polyethylene comes in sheets or beads and it is a low activation material. It is an excellent neutron shield, especially with boron added. With the addition of lead, it is also a good gamma shield. In the beaded form, the material will completely fill the gap in the shielding blocks with about 60 percent of the solid density, which will eliminate gap streaming of neutrons and gammas. It will also provide a flexible shield. The beaded form can be vacuumed out of the gap and blown back into it. This feature will reduce the radiation exposure to personnel since they would not handle the material directly. A vacuum system and storage canisters must be provided to handle the beads. A method of sealing the beads within the gaps would also have to be provided but a material such as duct tape could probably be used.

Ricorad TM combines exceptionally high hydrogen concentration with high temperature resistance. There is actually more hydrogen in Ricorad TM than there is in water. The maximum service temperature is 177° C. (350° F.). Ricorad TM comes in sheets and it can be worked like wood. It is a low activation material and it can be borated, which makes it a good neutron shield. It is not a good gamma shield.

Polystyrene is similar to polyethylene but it has a lower hydrogen concentration. Its useful temperature range increases with radiation exposure.

The water bag concept entails the use of a flexible bag material filled with water. The water bag concept is a good neutron shield; however, the radiation resistance of the bag material is low. Also, if the bags are removed and then replaced during a maintenance operation, the probability of a leak developing is high. The water can be easily drained and replaced and the bags provide a flexible shield. Aqua-Gel TM is a concept similar to the water bag but the water is in a semi-solid state. It cannot be drained as with water; therefore, it would be more difficult to handle during the maintenance operation.

Polyurethane provides some of the features of polyethylene and some of those of silicone foam. It comes in sheets or can be sprayed in place in the form of an aerosol. Like silicone foam, polyethylene film can be used as a "mold release" to assure that the polyurethane foam will not adhere to the shielding blocks. The maximum continuous service temperature is 100° C. It would reach a moderate activation level and as a neutron shield is intermediate between polyethylene (better) and polystyrene (worse). Its major drawback is that it produces hydrogen cyanide gas upon burning.

Conventional epoxy grouts feature moderately high hydrogen concentrations. Dependent upon the filler material used, they can be made moderately low in activation. The temperature and radiation stability can be increased by the addition of carbon black. They can be borated. Adhesion of the epoxy grout to the substrate would be the major problem. They are also expensive.

Experience with the materials listed in Table I has shown them to possess the following advantages and disadvantages:

Lead is not recommended for use as the "caulking" material for most nuclear reactor shielding applications because it is primarily a gamma shield material. It could have potential application in medical facilities or other installations using X-rays or Cobalt-60 sources. Lead is malleable, and it is conceivable that it could be deformed enough to conform to the contours and irregularities of the gaps. This is unlikely however. This problem could be overcome by melting the lead and pouring it into the joints but even this operation would not be entirely effective on joints in a horizontal plane.

Masonite TM is not suitable either. Unlike lead, it is not malleable and even in a $\frac{1}{8}$ inch thickness is probably not flexible enough to conform to the contours of the gap. Moreover, it is combustible.

Boral TM suffers from the same problem of being a solid. The addition of boron to the "caulking" material is not warranted unless there is a high degree of thermalization achieved in the shield. This material is also extremely expensive for this application.

Permali NH TM would be comparable to Masonite TM with respect to its possible use as a "caulking" and, because of its greater thickness, would not be as flexible. Permali JN TM 's boration would likewise not be required unless the shield thermalized the majority of the neutrons.

Silicone foam produces a good "caulking" material. When it is applied in the form of an aerosol, there would be no problems in distributing it into either vertical or horizontal gaps. The use of polyethylene film as a "mold release" would assure its separation from the shielding blocks. It can function as either a neutron or gamma shield or both. To be used as a gamma shield, lead would be added to the formulation. It has good temperature stability and is nonflammable. It would feature a fairly high activation dose due to the silicon activation. The disadvantage of this material is the fact that the raw material itself is fairly expensive, and the foam producing equipment is also.

Polyethylene would be a very attractive material were it not for its poor thermal stability. It melts between 150–160° F. and is unsuitable for use because of this.

Ricorad TM is an attrractive alternate to polyethylene as a neutron shield as it overcomes the service temperature problems of polyethylene. However, like the other solid sheet materials, it would be difficult to mold to the contours of the gaps. It would also be fairly expensive.

The water bag concept is not considered viable because of the high probability of leakage. Moreover, polyethylene bags would probably be used and these have the service temperature limitation.

Polystyrene is rejected for the same reason as polyethylene, i.e., low melting point. It melts at 130° F. In addition, it gives off carcinogenic fumes when ignited.

Polyurethane would be attractive were it not for the fact that it gives off hydrogen cyanide gas upon burning. It has been rejected for this reason.

The conventional epoxy grouts are attractive. They fulfill the basic requirements for a "caulking" or they would not be used as grouts. With different fillers, they can be used as neutron or gamma shields or both. They have good thermal stability and can be formulated to be low in neutron activation. Their major drawback would be in finding a "mold release" agent to prevent the shielding blocks from being cemented together into a monolithic structure.

It can readily be seen that the discovery of a gamma and neutron radiation shielding material which can overcome the adhesion problems of the prior art epoxy grouts while eliminating the economic problems associated with silicone foams would be highly beneficial. Accordingly, the development of a relatively inexpensive, but effective, gamma and neutron radiation shielding material has remained a problem in the art until the discovery of the present invention.

SUMMARY OF THE INVENTION

It is the primary object of the present invention to provide an inexpensive, recyclable, effective gamma and neutron radiation shielding material for use in the formation of a radiation shielding structure.

It is a further object of the present invention to provide a novel method of making a gamma and neutron radiation shielding structure which incorporates a novel, inexpensive, effective, recyclable gamma and neutron radiation shielding material.

It is an additional object of the present invention to provide an inexpensive, recyclable, effective gamma and neutron radiation shielding material capable of capturing thermalized neutrons.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention as embodied and described herein, the gamma and neutron radiation shielding material consists of a mixture of 95 to 97 percent by weight $SiO_2$ and 5 to 3 percent by weight sodium silicate.

Preferably, the radiation shield material comprises 95 to 97 percent by weight $SiO_2$ and 5 to 3 percent by weight sodium silicate wherein the sodium silicate has a specific gravity of about 40°Be'.

In another preferred embodiment of the present invention, the $SiO_2$ component of the mixture is selected within the fineness range of AFS 55 to 85.

In a further preferred embodiment of the present invention, a portion of the $SiO_2$ aggregate is replaced with boron to provide a radiation shielding material which would not only attenuate neutrons, but also capture them once thermalized. Preferably, the amount of boron added is between about 0.5 to 1.5 percent by weight.

In a further aspect of the present invention as embodied and described herein, the gamma and neutron radiation shielding structure may comprise a plurality of discrete shielding elements and a radiation shielding material consisting of $SiO_2$ and sodium silicate disposed between these elements and joining these elements one to the other.

In a preferred embodiment of this aspect of the present invention, the radiation shielding material consists of 95 to 97 percent by weight $SiO_2$ and 5 to 3 percent by weight sodium silicate.

In a still further aspect of the present invention as embodied and described herein, the method of making a gamma and neutron radiation shielding structure may comprise joining a plurality of discrete radiation shielding elements one to the other by disposing a radiation shielding material consisting of $SiO_2$ and sodium silicate between the elements, and curing the material.

In a preferred embodiment of this aspect of the present invention, the method comprises using a radiation shielding material consisting of 95 to 97 percent by weight $SiO_2$ and 5 to 3 percent by weight sodium silicate.

In a further preferred embodiment of the method of the present invention, the radiation shielding material consisting of $SiO_2$ and sodium silicate is provided by (1) recycling a previously cured radiation shielding material and (2) adding sodium silicate binder to this material in an amount sufficient to replace the sodium silicate lost during previous curing.

In another preferred embodiment of the present invention, the method of making a neutron and gamma radiation shielding structure comprises providing a plurality of discrete radiation shielding elements, providing a radiation shielding material consisting of $SiO_2$ and sodium silicate, disposing the radiation shielding material between the discrete radiation shielding elements to join said elements one to the other, and curing the radiation shielding material to form a substantial continuous radiation shielding structure.

In a further preferred embodiment of the method of the present invention, the curing is performed by introducing $CO_2$ gas into said radiation shielding material. Preferably, the $CO_2$ gas is introduced at a pressure of about 20 to 40 psi.

The radiation resistant material of the present invention overcomes the adhesion problems of the prior art epoxy grouts and, unlike the prior art silicone foams, can be produced inexpensively. In addition, this material can be used as both a neutron and gamma shield. The material maintains its strength over a wide range of temperatures. Tests of this material at temperatures as high as 1000° F. indicate no deterioration in its strength or properties.

DETAILED DESCRIPTION OF THE INVENTION

Sodium silicate is a viscous liquid which can be distributed over $SiO_2$ grains by conventional mulling techniques. The mixture of $SiO_2$ coated with sodium silicate is not free flowing and has a very low strength. However, by passing $CO_2$ gas through a compacted sodium silicate - $SiO_2$ mixture for a few minutes, a strong intergranular bond can be developed according to the following reaction:

$$Na_2O\cdot(X)SiO_2+(X)H_2O+CO_2\rightarrow Na_2CO_3+SiO_2\cdot(X)H_2O$$

where X is equal to 3, 4, or 5. This reaction produces sodium carbonate and hydrated silica which results in a neutron and gamma radiation shielding material.

In a preferred embodiment, 95 to 97 percent by weight $SiO_2$ and 5 to 3 percent by weight sodium silicate are mixed together in a conventional mulling apparatus.

Preferably, $SiO_2$ with a grain the size of about AFS 55 to 85 is selected. In addition, the $SiO_2$ should be as dry (moisture content in the range of 0.25 percent by weight) and clean (substantially free of lime, i.e., no more than 1 to 2 percent by weight) as possible.

The sodium silicate binder comprises about 7 to 28 percent $Na_2O$, about 26 to 64 percent $SiO_2$, and about 17 to 67 percent $H_2O$. In general, the sodium silicate is selected by weight ratio of $SiO_2$ to $Na_2O$. The most preferred silicates have a ratio ranging from 1:2 to 1.2:2. A typical sodium silicate for purposes of the present invention has a specific gravity of 40°Be'.

The $SiO_2$ and sodium silicate added to the mulling apparatus are mixed at a slow speed for a total time of about 3 to 5 minutes. It has been observed that the shortest mulling time that will accomplish dispersion is preferred because mixing for too long a period results in a dry, crumbly mixture which cannot be used. In addition, mixing should take place at room temperature because the viscosity of sodium silicate increases as temperature decreases. Once the radiation shielding material of the present invention has been made, it should be used relatively quickly (e.g., within one hour) to avoid partial hardening (curing). If it is necessary for the mixture to be held for any length of time prior to use, covering the mixture with a damp cloth will retard the natural hardening.

After the sodium silicate-$SiO_2$ mixture of the present invention has been made, construction of the radiation shielding structure can proceed according to the process of the present invention. The process of producing the gamma and neutron radiation shielding structure of the present invention comprises joining a plurality of discrete radiation shielding elements one to the other by disposing the above-described radiation shielding material between the elements, and drying this material to produce a continuous gamma and neutron radiation shielding structure. It should be noted that drying may take place naturally by curing via $CO_2$ in the air, or can be hastened by $CO_2$ gassing which is discussed below.

In a preferred embodiment of the method of the present invention, the structure is made by providing a plurality of discrete radiation shield elements, providing a radiation shielding material consisting of $SiO_2$ and sodium silicate, disposing the radiation shielding material between the elements, and curing the radiation shielding material. The disposition of the radiation shielding material may be performed by any conventional technique such as grouting.

In a further preferred embodiment of the method of the present invention, the radiation shielding material is placed into the gaps between or in the discrete radiation shielding elements. $CO_2$ probes made from a small diameter tubing (e.g., 3/16" OD steel tubing), either singly or connected in a manifold arrangement, are placed into the radiation shielding material. Each probe is capable of hardening (i.e., curing) a 6 inch diameter cylinder in about 20 seconds. Therefore, spacing of the probes should be substantially in accordance with this limitation. Gas pressure ($CO_2$) at the probe is 20 to 40 psi directed into the radiation shielding material curing the material. The gassing time should not be longer than necessary for developing an initial hardness that is sufficient to allow handling because overgassing results in marked losses in material strength. As a general rule, it has been found that one pound of $CO_2$ gas will cure 50 to 100 pounds of radiation shielding material.

Preferably, the gas probes have flare fittings and quick disconnectors on one end of the tubing. The other end is closed by squeezing. Two holes are drilled just above the closed end, at right angles to the longitudinal axis of the tubing. These tubes, so designed and provided with $CO_2$ gas, are capable of hardening a 6 inch diameter cylinder in about 20 seconds.

In another preferred embodiment of the present invention, a portion of the $SiO_2$ in the radiation shielding material of the present invention is replaced with a boron frit to provide a material which not only attenuates neutrons, but also captures them once thermalized. Preferably, the amount of boron added to the composition is between 0.5 to 1.5 percent by weight. Conventional boron frits such as those produced by Chi Vit Corporation of Oakbrook, Illinois, containing about 16 percent by weight boron in the frit are suitable. By way of illustration only, using the above described boron frit would entail replacement of from about 3 to 9 percent by weight $SiO_2$ to provide a boron content of 0.5 to 1.5 percent by weight in the resulting radiation shield material. The addition of the boron frit to the mixture of $SiO_2$ and sodium silicate can take place in the mulling apparatus followed by mixing at slow speeds as described previously.

In a further preferred embodiment of the method of the present invention, the radiation shielding material consisting of $SiO_2$ and sodium silicate is provided by (1) recycling a previously cured radiation shielding material, and (2) adding sodium silicate binder to this material in an amount sufficient to replace the binder lost during the previous curing procedure. In particular, the radiation shielding material of the present invention, upon curing, produces a friable product. This friable material can be reground using a conventional muller apparatus and sodium silicate can be added to this reground material to replace the binder lost during curing. The use of the previously cured radiation shielding material does not effect the radiation shielding properties of the material, making this material recyclable.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A material for use as a neutron and gamma radiation shield consisting of about 95 to 97 percent by weight $SiO_2$ and about 5 to 3 percent by weight sodium silicate.

2. The material of claim 1 wherein the sodium silicate has a specific gravity of about 40°Be'.

3. A radiation shielding structure capacity of preventing passage of neutron and gamma radiation comprising a plurality of discrete radiation shielding elements and a radiation shielding material disposed between said elements and joining said elements one to the other, said radiation shielding material consisting of a mixture of $SiO_2$ and sodium silicate.

4. The radiation shield structure of claim 3 wherein said radiation shielding material comprises about 95 to 97 percent by weight $SiO_2$ and 5 to 3 percent by weight sodium silicate.

5. A method of making a radiation shield structure capable of preventing passage of neutron or gamma radiation comprising joining a plurality of discrete radiation shielding elements one to the other by disposing a radiation shielding material consisting of $SiO_2$ and sodium silicate between said elements and curing said material.

6. The method of claim 5 wherein the radiation shielding material consists of 95 to 97 percent by weight $SiO_2$ and 5 to 3 percent by weight sodium silicate.

7. A method of making a radiation shielding structure capable of preventing passage of neutron or gamma radiationcomnprising:

a. providing a plurality of discrete radiation shield elements, b. providing a radiation shielding material consisting of $SiO_2$ and sodium silicate, c. disposing said radiation shielding material between said discrete radiation shield elements to join said elements one to the other to form a substantial continuous radiation shield structure, and d. curing said radiation shielding material.

8. The method of claim 7 wherein step (d) is performed by introducing $CO_2$ gas into said radiation shielding material.

9. The method of claim 8 wherein tubing is placed into said radiation shield material, and said $CO_2$ gas is introduced into said radiation shielding material through a small diameter tubing.

10. The method of claim 9 wherein said radiation shield material consists of about 95 to 97% by weight $SiO_2$ and about 5 to 3 percent by weight sodium silicate.

11. The method of claim 10 where said $CO_2$ gas is introduced into said radiation shield material at a pressure of about 20 to 40 psi.

12. A material capable of capturing thermalized neutrons for use as a neutron and gamma radiation shield consisting of about 94.5 to 95.5 percent by weight $SiO_2$, about 5 to 3 percent by weight sodium silicate and 0.5 to 1.5 percent by weight boron.

13. The method of claim 5 wherein the radiation shielding material is produced by (1) recycling a previously cured radiation shielding material, (2) grinding said recycled material, and (3) adding sodium silicate binder in an amount sufficient to replace said binder lost during said previous curing.

* * * * *